US007437784B1

(12) United States Patent
Turnipseed

(10) Patent No.: US 7,437,784 B1
(45) Date of Patent: Oct. 21, 2008

(54) MATTRESS COVER

(76) Inventor: Steven Turnipseed, 520 Wynne Haven Ct., Mary Esther, FL (US) 32569

( * ) Notice: Subject to any disclaimer, the term of this patent is extended or adjusted under 35 U.S.C. 154(b) by 0 days.

(21) Appl. No.: 11/804,980

(22) Filed: May 22, 2007

(51) Int. Cl.
*B65D 65/00* (2006.01)
*A47G 9/00* (2006.01)

(52) U.S. Cl. ..... 5/510; 5/922; 5/923; 294/152; 294/165; 383/18; 383/86; 383/99

(58) Field of Classification Search ..... 5/658, 5/737, 728, 922, 923, 482, 502, 496, 498, 5/510; 294/152, 165; 383/18, 86, 99; 224/157
See application file for complete search history.

(56) References Cited

U.S. PATENT DOCUMENTS 616,249 A * 12/1898 Nickerson ..... 383/16
2,343,260 A * 3/1944 Leader et al. ..... 5/499
4,119,250 A * 10/1978 Brutlag ..... 294/149
4,521,045 A * 6/1985 Hart ..... 294/149
4,679,242 A * 7/1987 Brockhaus ..... 383/4

* cited by examiner

*Primary Examiner*—Alexander Grosz
(74) *Attorney, Agent, or Firm*—Peter Loffler

(57) ABSTRACT

A mattress cover envelops a mattress in order to protect the mattress during moving and storage and has a body member that has a pair of faces joined by left and right side portions and a bottom portion forming an interior space with closed bottom, closed sides, and an open top. A flap extends upwardly from one of the faces and is releasably attachable to the other face in order to provide closure to the cover once a mattress is held therein. Side flaps extend from each side portion to provide added protection to the mattress. A strap extends along the bottom and up a section of each side portion. Loops on the ends of the strap provide carrying handles for the movers.

2 Claims, 2 Drawing Sheets

MATTRESS COVER

BACKGROUND OF THE INVENTION

1. Field of the Invention

The present invention relates to a protective mattress cover that protects a mattress from damage whenever the mattress is moved or stored.

2. Background of the Prior Art

Line workers in the moving industry have a difficult daily routine. Moving large, heavy and awkward household items from one house to another house can be back-breaking to say the least. Coupled with tight passageways and the inevitable inclement weather, furniture moving is a profession that is not suited for many. To add to the physical challenges associated with being a mover, many moving companies have policies that require the actual hands on mover to pay for any damages to the furniture occasioned during the move. As time is money, movers must constantly balance the need for speed with the desire to avoid costly moving mistakes.

One household item that is often overlooked when considering the fragility of household goods is the bed mattress. Although a mattress is bulky and somewhat awkward to carry, the mattress is relatively soft and many people fail to appreciate that the mattress can be easily damaged during a move. A mattress can be caught on another object and become torn. A liquid spill or even a grass stain caused by resting the mattress on the ground can easily soil the mattress. As such damage to a mattress tends not to be repairable, damaging the mattress results in the need to replace the mattress often to the tune of several hundred dollars. Therefore, the proper move of the mattresses in a given house can be the difference between a profitable move and a disaster to the actual movers.

Some movers attempt to protect the mattress by wrapping the mattress with some form of wrap such as blankets or even rolls of clear plastic wrap. However, such methods of mattress protection are time-consuming to implement, offer limited protection, and in the case of plastic wrap, tend to be expensive.

Accordingly, a device is needed that protects a mattress during moving of the mattress between locations and during storage of the mattress during an extended move. Such a device must not be time-consuming to implement and must offer the mattress substantial protection including protection from tears and stains. Such a device, which should be relatively simple in design and construction, must not have regular ongoing costs associated with its use.

SUMMARY OF THE INVENTION

The mattress cover of the present invention addresses the aforementioned needs in the art by providing a device that protects a mattress whenever the mattress is moved between locations or whenever the mattress is placed into storage. The mattress cover is relatively quick to place into protective covering relationship with the mattress to be moved so as not to be an undue time burden to the movers. The mattress cover gives the mattress substantial protection including protection from tears and stains. The present invention is of relatively simple design and construction and does not have ongoing costs associated with its use.

The mattress cover of the present invention is comprised of a body member that has a first face and a second face joined by a bottom portion, a left side portion, and a right side portion forming an interior space with a closed bottom, closed sides, and an open top. An outer surface of the first face has a first section of hook and loop material thereon. A main flap extends upwardly from the second face. The main flap has a second section of hook and loop material thereon such that the main flap is releasably attachable to the first face by cooperatively mating the first section of hook and loop material with the second section of hook and loop material. The body member receives a mattress within the interior space such that when the mattress is so received, the main flap is attached to the first face in order to place the main flap into covering relationship with the mattress so as to protect the mattress. A first side flap extends upwardly from the left side portion while a second side flap extends upwardly from the right side portion, each side portion placed over the mattress for additional mattress protection whenever the main flap is closed. A strap extends along the bottom portion, along a lower section of the left side portion, and along a lower section of the right side portion, the strap having a loop on either end thereof in order to provide carrying handles for users of the device. The body member has a water impervious layer.

BRIEF DESCRIPTION OF THE DRAWINGS

Similar reference numerals refer to similar parts throughout the several views of the drawings.

DESCRIPTION OF THE PREFERRED EMBODIMENT

Figure 1:
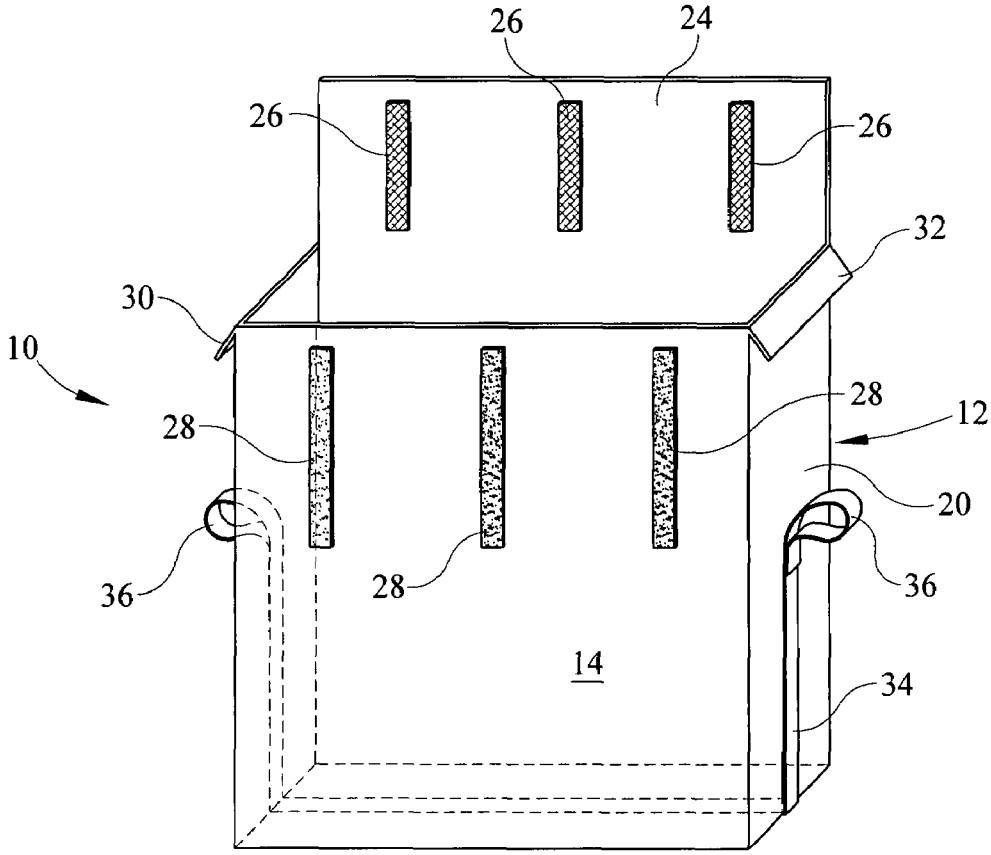
FIG. 1 is a perspective view of the mattress cover of the present invention with the top flap open.
Figure 2:
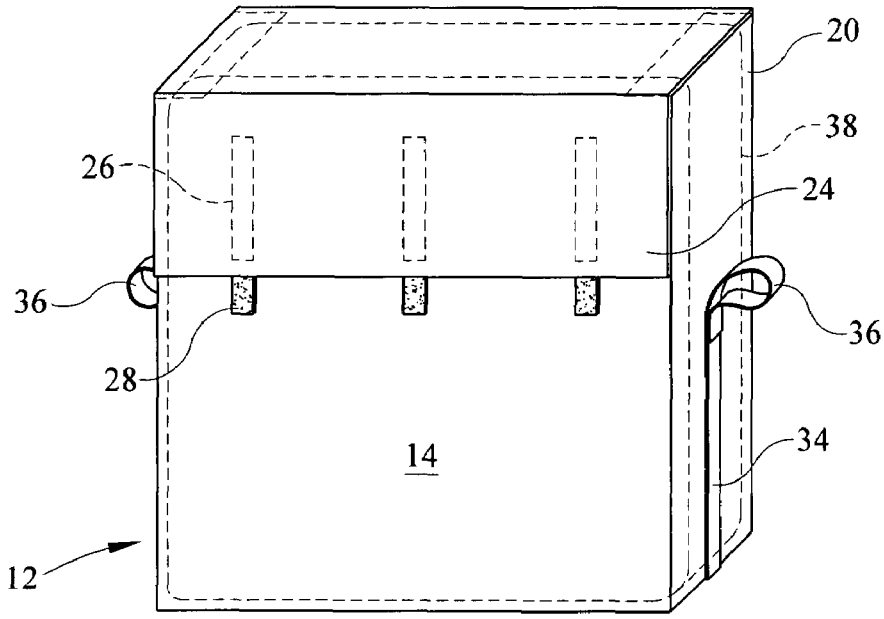
FIG. 2 is a perspective view of the mattress cover with the top flap closed.
Figure 3:
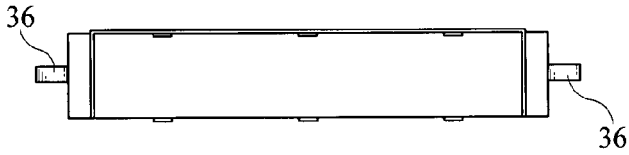
FIG. 3 is a top plan view of the mattress cover.
Figure 4:
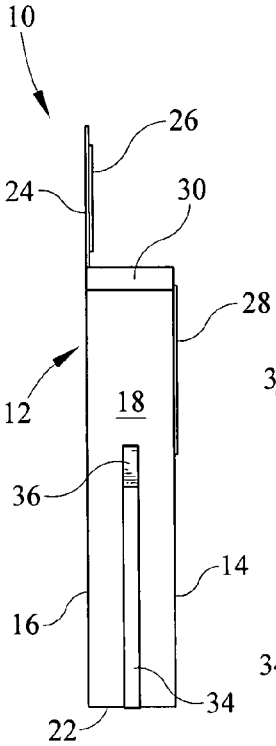
FIG. 4 is a left side view of the mattress cover.
Figure 5:
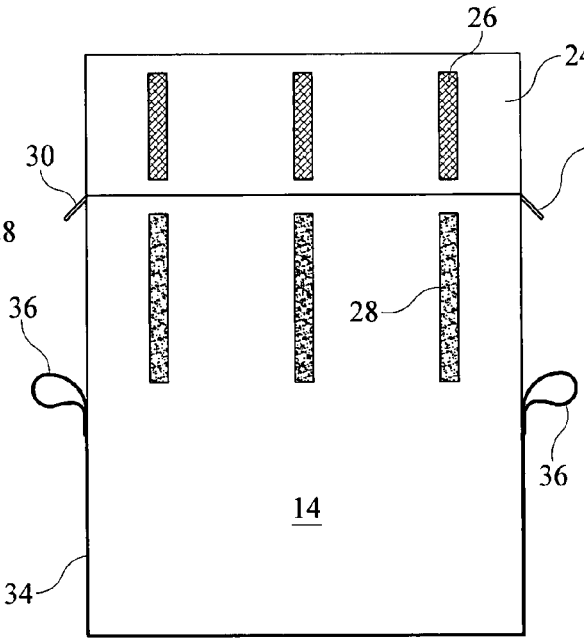
FIG. 5 is a front elevation view of the mattress cover.
Figure 6:
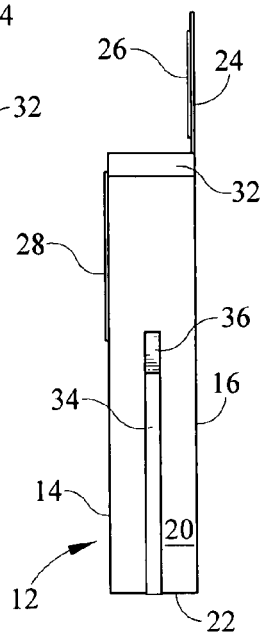
FIG. 6 is a right side view of the mattress cover.
Figure 7:
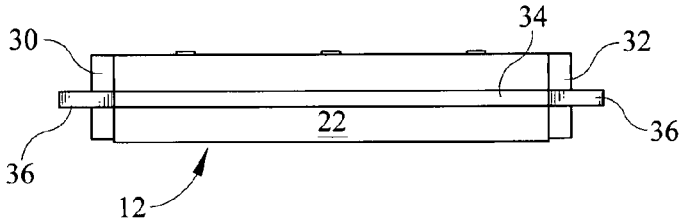
FIG. 7 is a bottom plan view of the mattress cover.

Referring now to the drawings, it is seen that the mattress cover of the present invention, generally denoted by reference numeral 10, is comprised of a body member 12 that has a front face 14 and a rear face 16 joined by a left side portion 18, a right side portion 20, and a bottom portion 22 forming an interior space with a closed bottom, closed sides, and an open top. Extending upwardly from the rear face 16 is a main flap 24, the main flap 24 having at least one first portion of cooperating hook and loop material 26 (which includes the new hook and dart material) thereon. A corresponding second portion of hook and loop material 28 is located on an outer surface of the front face 14 proximate the open top of the body member 12. A first side flap 30 extends upwardly from the left side portion 18 of the body member 12, while a second side flap 32 extends upwardly from the right side portion 20. A strap 34 extends laterally across the bottom portion 22 and extends upwardly along a section of the left side portion 18 and upwardly along a section of the right side portion 20, the strap 34 being attached to the bottom portion 22, the section of the left side portion 18, and the section of the right side portion 20. As seen, the strap 34 has loops 36 on either end thereof.

The body member 12 is made from any appropriate lightweight protective material such as canvas or cotton with a protective lining, made from an appropriate water impervious material such as Nylon, in order to make the body member 12 lightweight yet have the body member 12 offer substantial protection and be liquid impervious. The body member 12 may having padding as appropriate. The strap 34 is made from any appropriate strap material such as Nylon, leather, etc.

In order to use the mattress cover 10 of the present invention, a mattress 38 is placed into the interior of the body member 12. The side flaps 30 and 32 are flipped over the mattress 38 resting within the body member 12 and thereafter the main flap 24 is folded over the mattress 38 in order to cover the mattress 38 such that the first portion of hook and loop material 26 cooperatively mates with the second portion of hook and loop material 28 in order to close the main flap 24. The mattress 38 is now safely encased within the body member 12 and is protected by the body member 12. The loops 36 on the ends of the strap 34 are used by the movers to carry the mattress-bearing body member 12. The mattress cover 10 protects the mattress 38 therein from most of the common mattress hazards occasioned during a move including rips and tears. As the body member 12 has a water impervious layer or is otherwise made from a water impervious material, the potential for water damage to the mattress 38 is greatly minimized as is the potential for grass or other stains upon the mattress 38.

Upon arrival at the destination, the front flap 24 is opened, the mattress 38 removed from the body member 12, and the mattress 38 is placed at its desired location.

The body member 12 may be made in a single size for all mattresses 38 so that the inside dimensions of the body member 12 are slightly greater than 78 inches by 80 inches in order to hold a king size mattress and all other smaller mattresses including queen, double/full, twin, twin extra long, crib, etc. Alternately, each mattress cover 10 can be sized for a specific sized mattress 38 so that the inside dimensions of the body member 12 are slightly greater than the size of the mattress 38 to be accommodated. Additionally, the width of the body member 12 is sized so as to accommodate a regular style mattresses 38 as well as wider mattresses such as pillow-top-type mattresses. The inside of the body member 12 must be sufficiently large to allow the mattress 38 being placed thereinto to be so placed without undue effort.

While the invention has been particularly shown and described with reference to an embodiment thereof, it will be appreciated by those skilled in the art that various changes in form and detail may be made without departing from the spirit and scope of the invention.

I claim:

1. A cover, of a size adapted to enclose an adult size mattress, comprising:

a body member, comprised of a lightweight material with a protective lining made from a water impervious material, having a first face and a second face joined by a bottom portion, a left side portion, and a right side portion forming an interior space with a closed bottom, closed sides, and an open top;

a main flap extending upwardly from the second face, the main flap releasably attachable to the first face with the aid of spaced apart cooperating separable fasteners located on the main flap and the first face;

a first side flap extending upwardly from the left side portion; a second side flap extending upwardly from the right side portion; and a strap extending along the bottom portion, along a substantial portion of the left side portion, and along a substantial portion of the right side portion, the strap having a loop on both ends thereof;

wherein the body member is adapted to receive a mattress therein such that when the mattress is so received, the main flap is attached to the first face in order to protect the mattress.

2. The cover as in claim 1 in combination with the mattress.

* * * * *